US009962016B1

(12) United States Patent
Johnson et al.

(10) Patent No.: US 9,962,016 B1
(45) Date of Patent: May 8, 2018

(54) RETAIL DISPLAY BRACKET

(71) Applicant: Target Brands, Inc., Minneapolis, MN (US)

(72) Inventors: Jason W. Johnson, Wayzata, MN (US); Erin L. Zobel, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days. days.

(21) Appl. No.: 15/414,721

(22) Filed: Jan. 25, 2017

(51) Int. Cl.

| | |
|---|---|
| ***A47G 29/087*** | (2006.01) |
| ***F16M 11/00*** | (2006.01) |
| ***A47F 5/00*** | (2006.01) |
| ***A47F 7/00*** | (2006.01) |
| ***A47B 96/06*** | (2006.01) |

(52) U.S. Cl.
CPC ..... *A47F 5/0068* (2013.01); *A47B 96/06* (2013.01); *A47F 7/00* (2013.01)

(58) Field of Classification Search
CPC .. A47F 5/0068; A47F 7/00; A47F 5/16; A47F 5/0025; A47F 7/143; A47F 5/0823; A47F 1/128; A47F 5/0006; A47F 5/0807; G09F 1/00; G09F 3/204; G09F 1/04; A47B 96/063; A47B 96/067; A47B 96/066; A47B 96/061; A47B 96/06; F16M 13/02
USPC ..... 211/119.003, 119.004, 57.1, 59.1, 7; 40/124.01, 124.05, 124.06, 642.01, 40/642.02; 248/200, 205.1, 214, 220.21, 248/235, 247
See application file for complete search history.

(56) References Cited

U.S. PATENT DOCUMENTS

| | | | | |
|---|---|---|---|---|
| 2,312,532 A | | 3/1943 | Engstrom | |
| 2,639,040 A | * | 5/1953 | Tapley | A47F 5/0068 108/32 |
| 2,942,831 A | * | 6/1960 | Adams | A47F 5/0068 248/307 |
| 3,297,290 A | * | 1/1967 | Patterson | A47F 5/0068 211/59.1 |
| 3,904,041 A | * | 9/1975 | Medgebow | A47G 23/0641 211/72 |
| 4,151,972 A | | 5/1979 | Allegro | |
| 5,000,326 A | | 3/1991 | Vaughn | |
| 5,090,577 A | * | 2/1992 | Lehmann | A47F 5/0068 211/184 |
| 5,207,334 A | | 5/1993 | Lear | |
| 5,341,945 A | * | 8/1994 | Gibson | A47F 5/005 108/60 |
| 5,346,166 A | * | 9/1994 | Valiulis | A47F 5/0068 211/57.1 |

(Continued)

*Primary Examiner* — Jennifer E. Novosad
(74) *Attorney, Agent, or Firm* — Leanne Taveggia Farrell; Westman, Champlin & Koehler, P.A.

(57) ABSTRACT

A retail display bracket includes an upper panel member oriented downwardly from a bottom of a display shelf and located behind a front of the display shelf. A lower panel member is coupled to the upper panel member by a connecting panel member and is positioned forward from and below a front of the display shelf. Located on a front surface of the lower panel member are a plurality of sample products spaced apart from each other. A plurality of shelf tabs extend from a top end of the upper panel member and are inserted through perforations in the display shelf in a direction from the bottom of the display shelf to a top of the display shelf.

20 Claims, 4 Drawing Sheets

(56) References Cited

U.S. PATENT DOCUMENTS 5,415,370 A * 5/1995 Valiulis ..... A47F 5/0006 211/57.1
5,657,884 A * 8/1997 Zilincar ..... A47F 5/0043 211/103
5,660,284 A 8/1997 Vaughn
5,678,795 A * 10/1997 Henry ..... A47F 5/0068 211/57.1
5,908,119 A * 6/1999 Kump ..... A47F 5/0068 211/113
5,924,579 A * 7/1999 DuPont ..... A45D 44/02 211/106
5,931,316 A * 8/1999 Carpinelli ..... A47F 7/14 108/26
5,979,675 A * 11/1999 Moriarty ..... B01L 9/54 211/119.003
6,119,990 A * 9/2000 Kump ..... A47F 5/0068 211/57.1
6,164,445 A 12/2000 Cooper
6,299,002 B1 * 10/2001 Garnier ..... A47F 5/0068 211/162
6,354,546 B1 * 3/2002 Mueller ..... A47F 5/0068 248/220.41
6,497,329 B1 12/2002 Johnson et al.
6,634,125 B2 * 10/2003 Abramson ..... G09F 3/204 40/642.02
7,114,623 B2 * 10/2006 Robinson ..... A47F 7/0021 211/85.26
7,600,645 B2 * 10/2009 Gregory ..... A47F 7/12 211/85.3
7,641,061 B1 * 1/2010 Cuzzocrea ..... A47F 5/0006 211/113
7,882,969 B2 * 2/2011 Gerstner ..... A47F 3/14 211/119.003
8,079,478 B2 * 12/2011 Short ..... A45D 40/0087 206/734
8,152,006 B2 * 4/2012 Wamsley ..... A47F 3/002 211/119.003
8,333,285 B2 * 12/2012 Kiehnau ..... A47F 5/0068 211/119.003
8,573,412 B2 * 11/2013 Schwartz ..... A47F 5/0068 211/119.003
8,763,819 B2 * 7/2014 Theisen ..... A47F 5/0025 211/119.003
9,622,595 B2 * 4/2017 Kozak ..... A47F 5/0869
9,741,269 B2 * 8/2017 Ellingson ..... G09F 7/20
2003/0178384 A1 * 9/2003 Speed ..... A47F 5/0068 211/119.003
2004/0050812 A1 * 3/2004 Rojas ..... A47F 5/0068 211/134
2004/0200793 A1 * 10/2004 Hardy ..... A47F 5/0068 211/119.003
2004/0237369 A1 * 12/2004 Andersson ..... A47F 5/0068 40/661.03
2005/0139560 A1 * 6/2005 Whiteside ..... A47B 57/586 211/119.003
2006/0108304 A1 * 5/2006 Kanou ..... A47F 3/04 211/119.003
2007/0163971 A1 * 7/2007 Kosir ..... A47F 5/0068 211/59.2
2007/0205167 A1 * 9/2007 Belokin ..... A47F 5/0018 211/75
2007/0251905 A1 * 11/2007 Trotta ..... A47F 5/0068 211/119.003
2008/0099418 A1 5/2008 Wells
2009/0115299 A1 5/2009 Ricereto
2009/0134103 A1 * 5/2009 Saxena ..... A47F 5/0068 211/153
2011/0132854 A1 * 6/2011 Berdahl ..... A47F 3/12 211/59.2
2012/0048817 A1 * 3/2012 Green ..... A47F 5/0068 211/59.3
2013/0298376 A1 * 11/2013 Hawkins ..... B23P 17/04 29/428
2015/0008203 A1 * 1/2015 Misener ..... A47F 5/0068 211/134
2015/0282616 A1 10/2015 Weis
2016/0198867 A1 7/2016 Mendelowitz et al.

* cited by examiner

RETAIL DISPLAY BRACKET

BACKGROUND

Retail stores use a variety of display fixtures to present products to customers for purchase. These display fixtures can support the product, indicate the product price, include signage for highlighting the product and/or include structures that hold samples of the product. Exemplary display structures include shelves, trays, racks, peg hooks and other similar structures.

The discussion above is merely provided for general background information and is not intended to be used as an aid in determining the scope of the claimed subject matter.

SUMMARY

A retail display bracket is coupled to a display shelf. The retail display bracket includes an upper panel member oriented downwardly from a bottom of a display shelf and located behind a front of the display shelf. A lower panel member is coupled to the upper panel member by a connecting panel member and is positioned forward from and below a front of the display shelf. Located on a front surface of the lower panel member are a plurality of sample products spaced apart from each other. A plurality of shelf tabs extend from a top end of the upper panel member and are inserted through perforations in the display shelf in a direction from the bottom of the display shelf to a top of the display shelf.

A retail display bracket includes an upper flange having a top end, a bottom end and being oriented substantially vertically. A middle flange is oriented substantially horizontally and extending forward from the bottom end of the upper flange to a front end. A lower flange downwardly extends from the front end of the middle flange and is configured to receive sample products for displaying to customers. A plurality of tabs extend from the top end of the upper flange. The front end of the middle flange is located forward from and below the upper flange and the lower flange extends downwardly from the front end of the middle flange.

A method of displaying sample products on a gondola display unit is provided. The method includes mounting a retail display bracket to a shelf of the gondola display unit by inserting a plurality of shelf tabs into perforations in a direction from a bottom of the shelf to a top of the shelf. Each of the plurality of shelf tabs extend from an upper panel member that is oriented downwardly from a bottom of the shelf and is coupled to a lower panel member that is oriented downwardly from the shelf and in a location forward from a front of the shelf. The sample products are displayed on the lower panel member by locating the sample products on a front surface of the lower panel member.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The retail display bracket described herein holds product samples or miniature sizes of products samples, such as lids for cookware, in various colors. Based on the different colors of product samples, a customer selects for purchase the color of merchandise, such as cookware, that is desired. The retail display bracket connects to and protrudes from a gondola display shelf without blocking or interfering with price labels or price label holders located on the front of the shelf. The plurality of product samples are mounted adjacent to each other on a downwardly depending member of the retail display bracket for ease of viewing, comparing and selecting.

Figure 1:
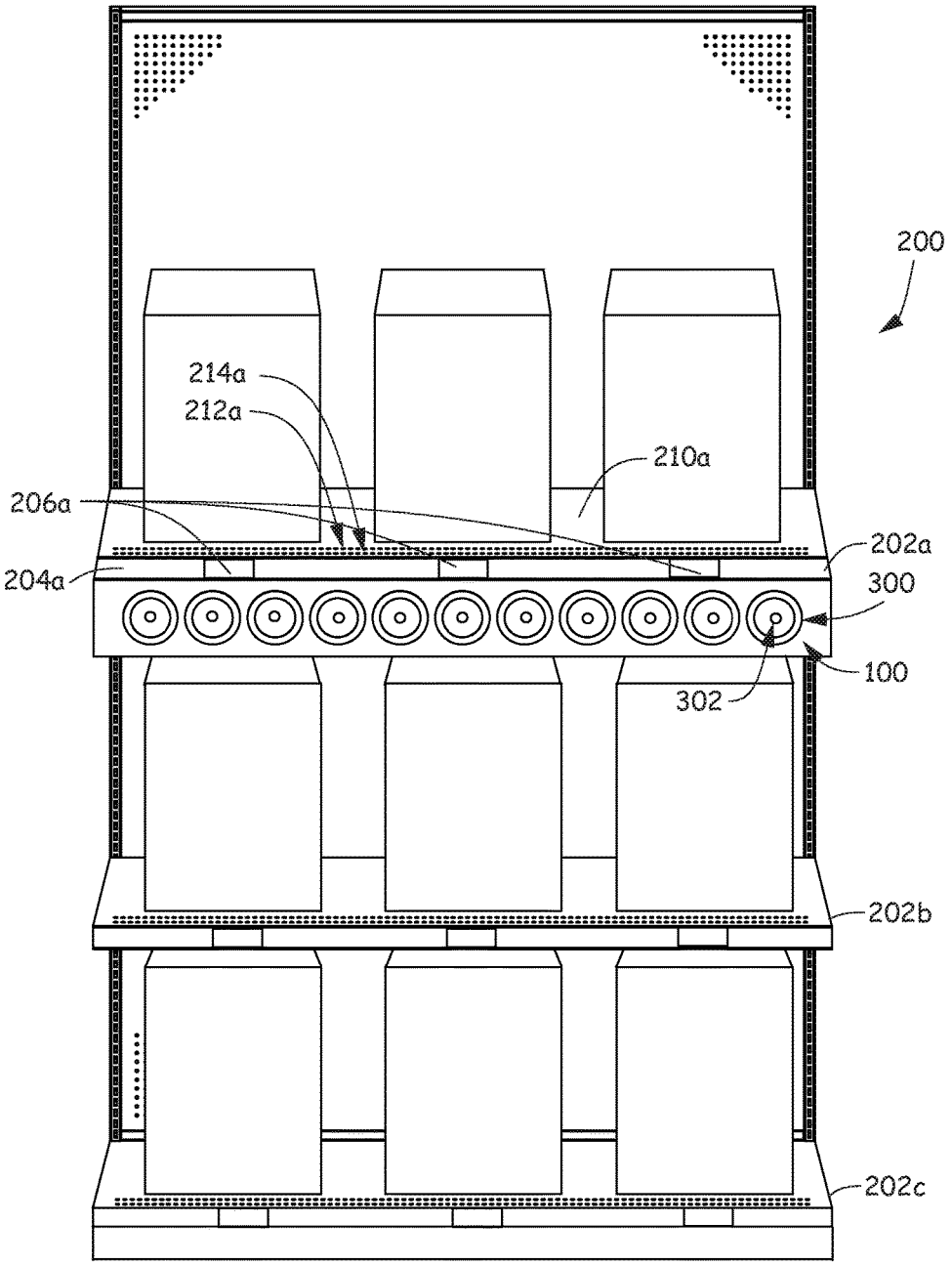
FIG. 1 is perspective view of a gondola display unit having a plurality of display shelves with a retail display bracket for displaying sample lids of cookware in various colors being coupled to one of the shelves 202*a* according to one embodiment.

FIG. 1 is perspective view of a gondola display unit 200 having a plurality of display shelves 202*a*, 202*b* and 202*c* with a retail display bracket 100 for displaying product samples according to one embodiment. In the embodiment in FIG. 1, the product samples are the lids, whether or not the lids are true to size, of cookware being offered for sale in various colors. Retail display bracket 100 is coupled to one of the shelves of gondola display unit 200. As illustrated, retail display bracket 100 is coupled to the uppermost shelf 202*a* and is configured to hold different colors of lids 300 below a front 204*a* of shelf 202*a*. In this way, price labels 206*a* showing the price of the merchandise being supported by shelf 202*a* are not blocked from view by the samples of lids 300. In the embodiment illustrated in FIG. 1, not only is boxed merchandise stocked on shelf 202*a*, but additional boxed merchandise is stocked on shelves 202*b* and 202*c* located below shelf 202*a* and retail display bracket 100.

Figure 2:
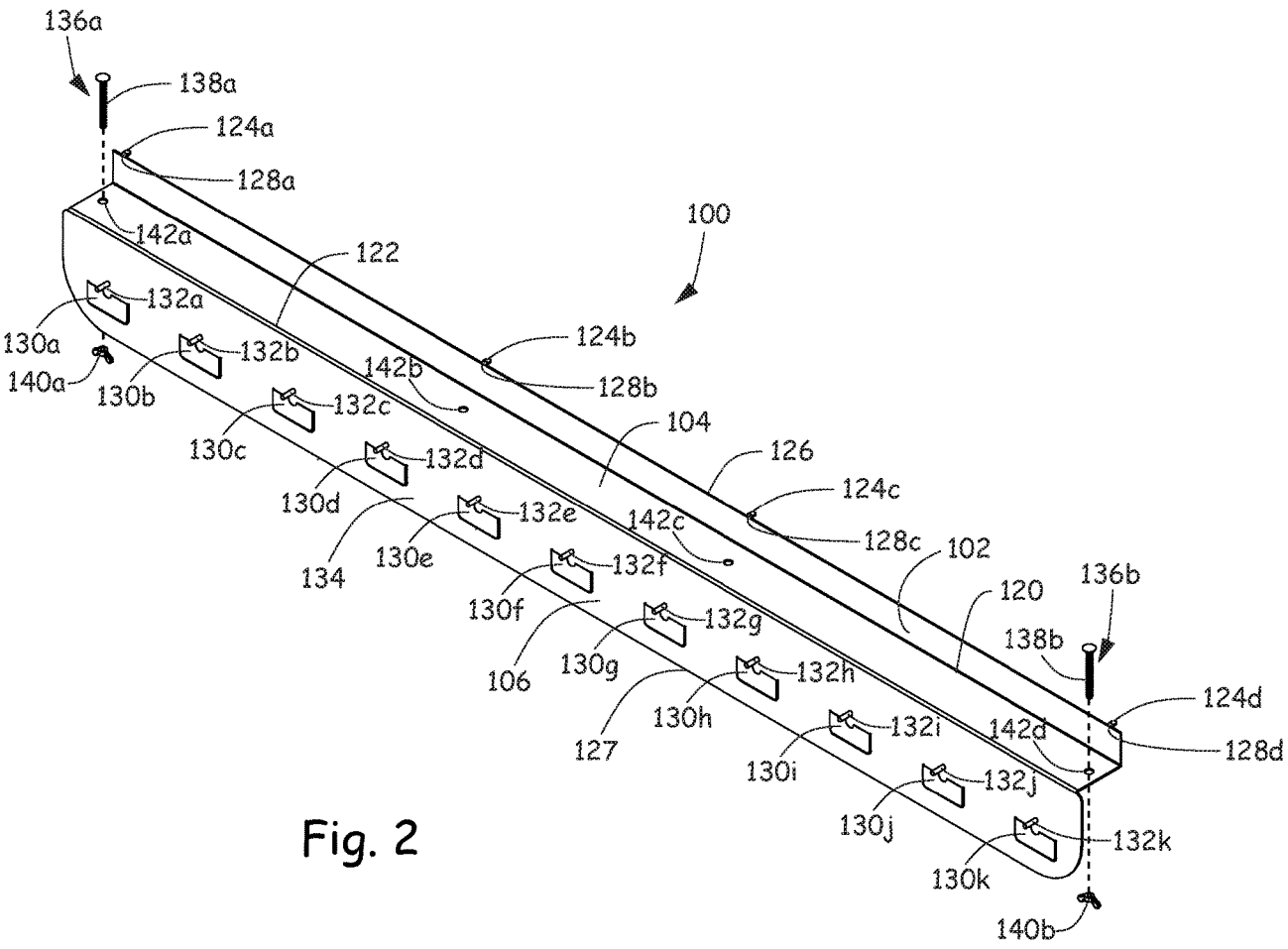
FIG. 2 is a perspective view of the retail display bracket illustrated in FIG. 1 according to one embodiment.
Figure 3:
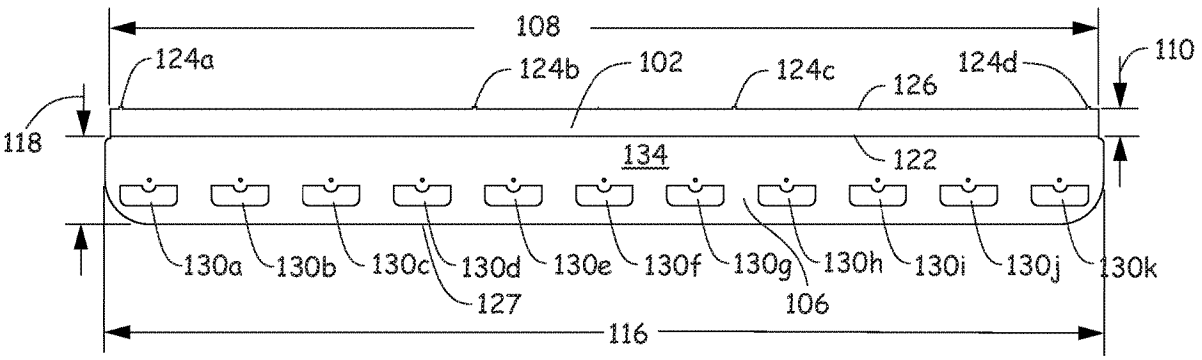
FIG. 3 is a front view of the retail display bracket in FIG. 2.
Figure 4:
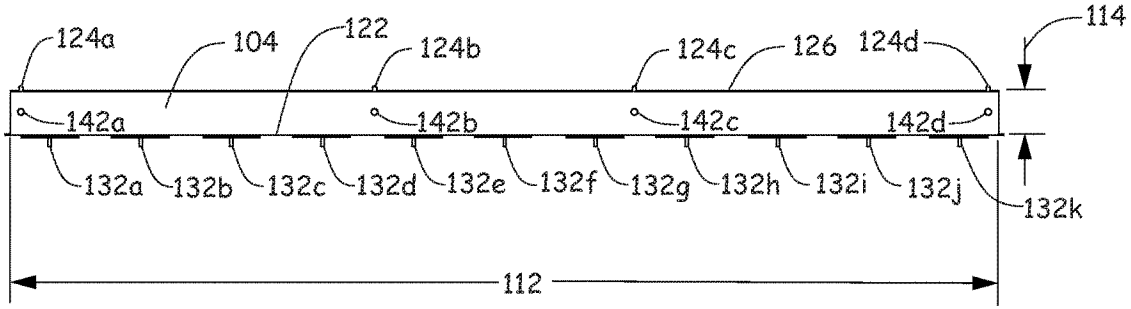
FIG. 4 is a top view of the retail display bracket in FIG. 2.
Figures 5, 6:
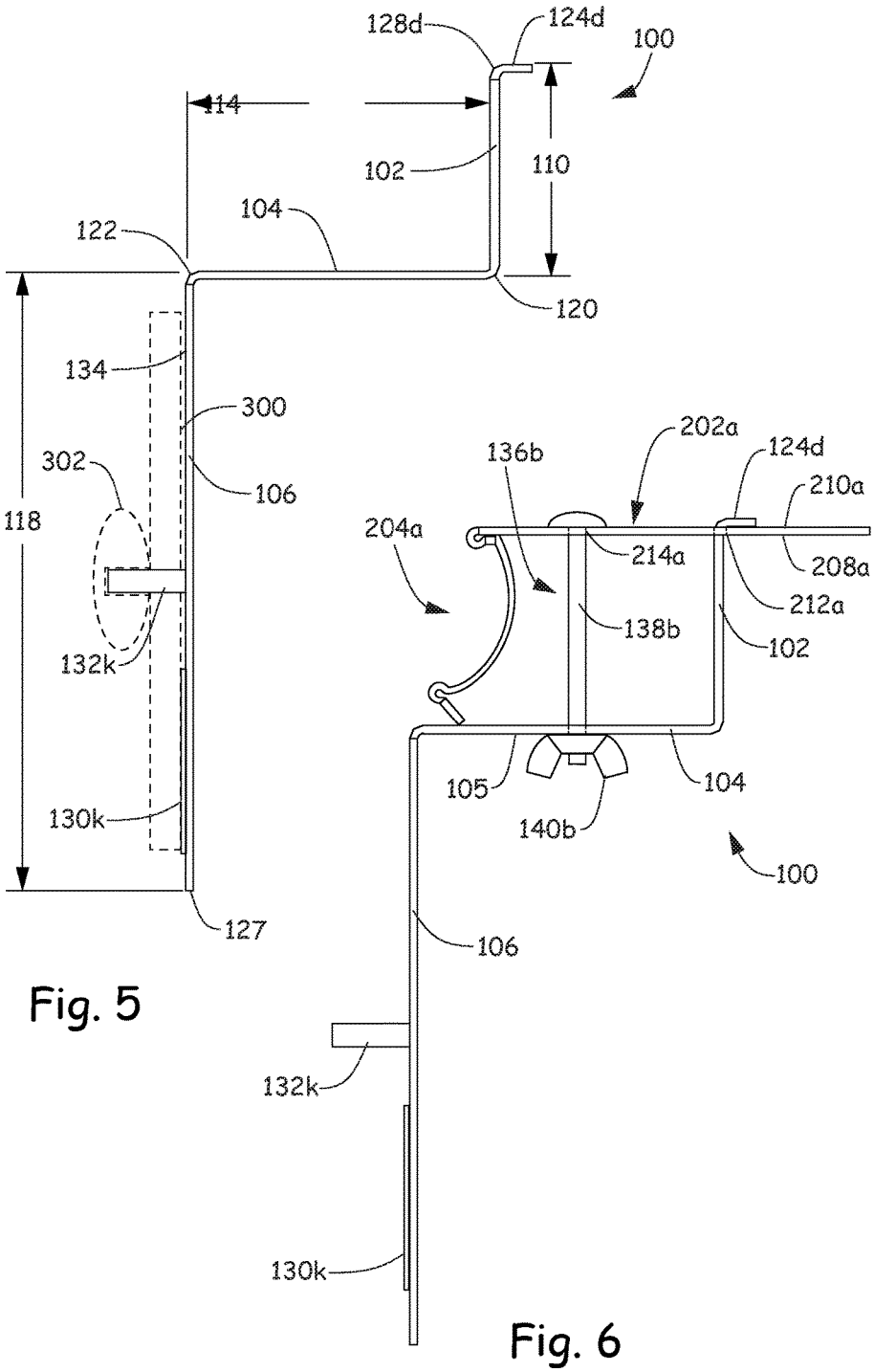
FIG. 5 is a side view of the retail display bracket in FIG. 2.
FIG. 6 is a side view of a portion of a gondola display shelf with the retail display bracket connected thereto.

FIG. 2 is a perspective view of retail display bracket 100 according to one embodiment. FIG. 3 is a front view, FIG. 4 is a top view and FIG. 5 is an end or side view of retail display bracket 100. Retail display bracket 100 includes an upper panel member or upper flange 102, a connecting panel member or middle flange 104 and a lower panel member or lower flange 106. Upper flange 102 is a panel member that is oriented substantially vertically, has a length 108 and has a height 110 defined between a top end 126 and a bottom end 120. Middle flange 104 is a panel member extending forward from bottom end 120 of upper flange 102 to a front end 122, is oriented substantially horizontally, has a length 112 and has a depth 114 defined between front end 122 of middle flange 104 and bottom end 120 of upper flange 102. Length 112 of middle flange 104 is substantially the same as length 108 of upper flange 102. Lower flange 106 is a panel member downwardly extending from front end 122 of middle flange 104, is oriented substantially vertically, has a length 116 and has a height 118 defined between front end 122 of middle flange 104 and a bottom end 127 of lower flange 106. Lower flange 106 is substantially perpendicular to middle flange 104 and substantially parallel to upper flange 102. Length 116 of lower flange 106 is only slightly greater than lengths 108 and 112 of upper flange 102 and middle flange 104, respectively. Lower flange or lower panel member 106 is connected to upper flange or upper panel member 102 by middle flange or connecting panel member 104.

Retail display bracket 100 further includes a plurality of shelf tabs 124*a*, 124*b*, 124*c* and 124*d*. Each shelf tab 124*a-d* extends from top end 126 of upper flange 102. More particularly, each shelf tab 124*a-d* extends from top end 126 in a direction backwards from upper flange 102, middle flange 104 and lower flange 106 and is oriented substantially horizontally. In other words, each shelf tab 124*a-d* is substantially parallel with middle flange 104 and substantially perpendicular with upper flange 102 and lower flange 106.

As illustrated in FIGS. 2-5 and under one embodiment, the main components of retail display bracket 100, such as upper flange 102, middle flange 104, lower flange 106 are made of a single, continuous piece of a material. For example, retail display bracket 100 can be made of a single sheet of metal, such as steel, that is bent to form upper flange 102, middle flange 104 and lower flange 106. A first bend is located at bottom end 120 of upper flange 102 and defines the connection between upper flange 102 and middle flange 104 and the second bend is located at front end 122 of middle flange 104 and defines the connection between middle flange 104 and lower flange 106. It should be realized that in other embodiments retail display bracket 100 can be made of multiple different parts coupled or welded together. In the illustrated embodiment, where the main components of retail display bracket 100 are made of from a single, continuous piece of material, shelf tabs 124*a-d* are also formed from this single, continuous piece of material. Each third bend 128*a-d* defines the connection between upper flange 102 and each shelf tab 124*a-d*.

Still further, a plurality of threaded studs or mounting posts 132*a-k* and a plurality of transparent pockets 130*a-k* are coupled to a front surface 134 of lower flange 106. Each transparent pocket 130*a-k* is located below one of the plurality of threaded studs or mounting posts 132*a-k*. Each stud or mounting post 132*a-k* is spaced across and along length 116 of lower flange 106 along the approximate middle of lower flange 106 and protrudes from front surface 134 of lower flange 106 to terminating ends. Each stud or mounting post 132*a-k* is configured to engage with a sample product. In the embodiment illustrated in FIGS. 1 and 5, each sample lid (in FIG. 5 the sample lid 300 and handle 302 are shown in phantom) engages with or is mounted to one of the plurality of threaded studs or mounting posts protruding from lower flange 106 with the handle 302 of one of the sample lids through an opening in the lid. More specifically, the handle 302 of each sample lid 300 is mounted to a top of the lid and includes a threaded receiver that aligns with an opening in the lid and receives the threaded stud or post 132*a-k*. The receiver of the sample lid normally receives a screw for securing the handle to the lid, but in this case the sample lid receives the threaded stud on lower flange 106 thereby securing the sample lid to lower flange 106.

Each transparent sleeve or pocket 130*a-k* is coupled to front surface 134 of lower flange 106 by, for example, an adhesive. Each transparent sleeve or pocket 130*a-k* is located on front surface 134 of lower flange 106 so that the sample product that is engaged with the stud or mounting post directly above the transparent sleeve or pocket hides the transparent sleeve or pocket from view. Each of the plurality of sleeves or pockets 130*a-k* is configured to receive or contain a tag including indicia describing which of the plurality of sample products should be engaged with the stud or mounting post directly above the transparent sleeve or pocket. In the embodiment illustrated in FIGS. 1-5, different color lids are engaged with or mounted to the plurality of threaded studs or mounting posts 132*a-k*. The tag in the transparent sleeve or pocket below each stud or mounting post 132*a-k* indicates which color should be engaged with the stud or mounting post directly above the transparent sleeve or pocket.

FIG. 6 is an end view or side view of a portion of gondola display shelf 202*a* with retail display bracket 100 connected thereto. As illustrated, upper flange 102 is oriented downwardly from a bottom 208*a* of display shelf 202*a* and located behind front 204*a* of display shelf 202*a*. Middle flange 104 extends from bottom end 120 to front end 122, which is located forward from and below front 204*a*. Lower flange 106 is coupled to upper flange 102 by middle flange 104 and is entirely positioned forward from and below front 204*a* of display shelf 202*a*. The position of lower flange 106 relative to bottom 208*a* and front 204*a* of display shelf 202*a* is important so that sample products engaged with lower flange 106 do not block price labels that are attached to front 204*a* of display shelf 202*a*.

Each of the plurality of shelf tabs 124*a-d* are inserted through a respective perforation in display shelf 202*a*. As illustrated in FIG. 6, shelf tab 124*d* is inserted through a first perforation 212*a* (shown in phantom lines) in a direction from bottom 208*a* of display shelf 202*a* to a top 210*a* of display shelf 202*a* to position retail display bracket 100 relative to display shelf 202*a*. This is done by inserting each terminating end of shelf tabs 124*a-d* through first perforations 212*a* in display shelf 202*a* and rotating the entirety of retail display bracket 100 into the position shown in FIG. 6. Retail display bracket 100 is further secured to display shelf 202*a* by a plurality of fasteners. Each of the plurality of fasteners 136*a-b* (FIG. 2 illustrating fasteners 136*a-b* exploded and FIG. 6 illustrating fastener 136*b* unexploded) connects the middle flange 104 to display shelf 202*a*.

Each fastener 136*a-b* includes a bolt 138*a-b* and a nut 140*a-b*, such as a wing nut. Each bolt 138*a-b* extends from top 210*a* of display shelf 202*a* through one of second perforations 214*a* (shown in phantom lines) in display shelf 202*a* and further through one of the holes 142*a-d* in middle flange 104. Nut 140*a-b* then secures bolt 138*a-b* in place by engaging with the bolt against a bottom surface 105 of middle flange 104. While FIGS. 2 and 6 illustrate two fasteners 136*a-b*, it should be realized that more fasteners can be used as indicated by the two extra holes located in middle flange 104 in FIGS. 2 and 4.

First and second perforations 212*a* and 214*a* are shown in FIG. 1. Display shelf 202*a* includes a first row of first perforations 212*a* that extend between top 210*a* and bottom 208*a* of display shelf 202*a* and a second row of second perforations 214*a* that extend between top 210*a* and bottom 208*a* of display shelf 202*a*. The second row of second perforations 214*a* is located in front of the first row of first perforations 212*a*.

To display sample products on gondola display unit 200, retail display bracket 100 is mounted to display shelf 202*a* by inserting the plurality of shelf tabs 124*a-d* into first perforations 212*a* that are part of a first row of perforations in display shelf 202*a* in a direction from bottom 208*a* of display shelf 202*a* to top 210*a* of display shelf 202*a*. Sample products 300 are displayed on lower flange 106 by coupling the sample products on front surface 134. Retail display bracket 100 is further secured to display shelf 202*a* by fastening middle flange 104 to display shelf 202*a*. In particular, bolts 138*a-b* are respectively inserted from top 210*a* of display shelf 202*a* through a respective perforation 214*a* in display shelf 202*a* to bottom 208*a* and through a respective hole 142*a-d* in middle flange 104. A respective nut 140*a-b* is then attached to a bottom of bolt 138*a-b* to complete the fastening.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display bracket comprising:

an upper panel member adapted to be oriented downwardly from a bottom of a display shelf and adapted to be located behind a front of the display shelf;

a lower panel member coupled to the upper panel member by a connecting panel member and adapted to be positioned forward from and below the front of the display shelf, wherein the lower panel member includes a front surface configured to hold a plurality of sample products spaced apart from each other along the front surface; and a plurality of shelf tabs extending from a top end of the upper panel member and adapted to be inserted through perforations in the display shelf in a direction from the bottom of the display shelf to a top of the display shelf.

2. The retail display bracket of claim 1, wherein the plurality of shelf tabs extending from the top end of the upper panel member are oriented substantially perpendicularly relative to the upper panel member.

3. The retail display bracket of claim 1, wherein the plurality of shelf tabs, the upper panel member, the connecting panel member and the lower panel member all comprise a single, continuous material and the plurality of shelf tabs, the upper panel member, the connecting panel member and the lower panel member are each connected together and defined by a plurality of bends.

4. The retail display bracket of claim 1, further comprising a plurality of studs spaced apart from each other along the lower flange and protruding from the front surface of the lower panel member to terminating ends, wherein each stud is adapted to engage with one of the sample products.

5. The retail display bracket of claim 4, further comprising a plurality of transparent sleeves each coupled to the front surface of the lower panel member and being located below each of the plurality of studs, wherein each transparent sleeve is located so that each sample product that is adapted to be engaged with each stud is configured to be located directly over the transparent sleeve to hide the transparent sleeve from view.

6. The retail display bracket of claim 5, wherein each of the plurality of transparent sleeves contains a tag including indicia describing which of the plurality of sample products should be adapted to be engaged with the stud directly above the transparent sleeve.

7. The retail display bracket of claim 1, further comprising a plurality of fasteners that are configured to further secure the retail display bracket to the display shelf, wherein each of the plurality of fasteners is adapted to fasten the connecting panel member to the display shelf.

8. The retail display bracket of claim 7, wherein each fastener comprises a bolt and nut, the bolt is adapted to extend from the top of the display shelf through a second perforation in the display shelf and a hole in the connecting panel member and the nut securing the bolt in place by engaging with the bolt against a surface of the connecting panel member.

9. The retail display bracket of claim 8, wherein the plurality of shelf tabs that are adapted to be inserted through perforations in the display shelf are adapted to be inserted through part of a first row of first perforations extending between the top of the display shelf and the bottom of the display shelf and wherein each bolt of each fastener that is adapted to extend through the second perforation in the display shelf is adapted to extend through part of a second row of second perforations extending between the top of the display shelf and the bottom of the display shelf, the second row of perforations being located in front of the first row of perforations.

10. A retail display bracket comprising:

an upper flange having a top end, a bottom end and being oriented substantially vertically;

a plurality of tabs extending from the top end of the upper flange and configured to be inserted through holes in a display shelf to mount the upper flange to the display shelf, wherein the upper flange is adapted to be oriented downwardly from a bottom of the display shelf and adapted to be located behind a front of the display shelf;

a middle flange oriented substantially horizontally and extending forward from the bottom end of the upper flange to a front end;

a lower flange downwardly extending from the front end of the middle flange and configured to receive sample products for displaying to customers, wherein the lower flange is adapted to be positioned forward of the front of the display shelf; and wherein the front end of the middle flange is located forward from the upper flange and the lower flange extends downwardly from the front end of the middle flange.

11. The retail display bracket of claim 10, wherein the plurality of tabs extending from the top end of the upper flange are oriented substantially horizontally and therefore substantially perpendicularly to the upper flange.

12. The retail display bracket of claim 10, wherein the plurality of tabs, the upper flange, the middle flange and the lower flange all comprise a single, continuous material and the plurality of tabs, the upper flange, the middle flange and the lower flange are each connected together and defined by a plurality of bends.

13. The retail display bracket of claim 10, further comprising a plurality of mounting posts protruding from the front surface of the lower flange to terminating ends, wherein each mounting post is configured to engage with a sample product.

14. The retail display bracket of claim 13, wherein the plurality of mounting posts are spaced apart from each other along the lower flange.

15. The retail display bracket of claim 13, further comprising a plurality of transparent pockets each coupled to the front surface of the lower flange and being located below a respective mounting post, wherein each transparent pocket is located so that the sample product that is configured to engage with the mounting post directly above the transparent pocket is configured to hide the transparent pocket from view.

16. The retail display bracket of claim 15, wherein each of the plurality of transparent pockets is configured to contain a tag including indicia describing which of the plurality of sample products should be engaged with the mounting post directly above the transparent pocket.

17. A method of displaying sample products comprising:

providing a display shelf;

providing a retail display bracket having an upper panel member and a lower panel member that is coupled to the upper panel member;

mounting the retail display bracket to the display shelf by inserting a plurality of shelf tabs that extend from the upper panel member through perforations in the display shelf in a direction from a bottom of the shelf to a top of the shelf, wherein the upper panel member is oriented downwardly from a bottom of the display shelf and the lower panel member is adapted to be oriented downwardly from the display shelf and in a location forward from a front of the display shelf; and displaying sample products adapted to be located on a front surface of the lower panel member.

18. The method of claim 17, further comprising securing the retail display bracket to the display shelf by fastening a middle panel member to the shelf, wherein the middle panel member connects the upper panel member to the lower panel member and positions the lower panel member in front of the shelf.

19. The method of claim 18, wherein fastening the middle panel member to the display shelf comprises inserting a bolt from the top of the display shelf through a perforation in the display shelf and through a hole in the middle panel member that extends from a top surface of the middle panel member to a bottom surface of the middle panel member.

20. The method of claim 19, wherein fastening the middle panel member to the shelf further comprises attaching a nut to the bolt so that the nut engages with the bottom surface of the middle panel member.

* * * * *